US008289121B2

(12) United States Patent
Yan et al.

(10) Patent No.: US 8,289,121 B2
(45) Date of Patent: Oct. 16, 2012

(54) MINIATURE SHIELDED MAGNETIC COMPONENT

(75) Inventors: Yipeng Yan, Shanghai (CN); Robert J. Bogert, Lake Worth, FL (US); Baoqi Wang, Hubei (CN)

(73) Assignee: Cooper Technologies Company, Houston, TX (US)

( * ) Notice: Subject to any disclaimer, the term of this patent is extended or adjusted under 35 U.S.C. 154(b) by 51 days.

(21) Appl. No.: 12/138,792

(22) Filed: Jun. 13, 2008

(65) Prior Publication Data

US 2008/0310051 A1 Dec. 18, 2008

(30) Foreign Application Priority Data

Jun. 15, 2007 (CN) ..... 2007 1 0111096

(51) Int. Cl.

| | |
|---|---|
| ***H01F 17/04*** | (2006.01) |
| ***H01F 27/02*** | (2006.01) |
| ***H01F 17/06*** | (2006.01) |
| ***H01F 27/28*** | (2006.01) |
| ***H01F 27/29*** | (2006.01) |
| ***H01F 7/06*** | (2006.01) |

(52) U.S. Cl. ..... 336/221; 336/83; 336/178; 336/222; 336/192; 29/602.1

(58) Field of Classification Search ..... 336/200, 336/83, 178, 192, 220–222; 29/602.1, 605–607; 360/123.1

See application file for complete search history.

(56) References Cited

U.S. PATENT DOCUMENTS

| | | | | |
|---|---|---|---|---|
| 2,350,724 | A * | 6/1944 | Camilli | 336/60 |
| 2,714,709 | A * | 8/1955 | Diebold | 336/61 |
| 3,284,748 | A * | 11/1966 | Matsumoto | 336/233 |
| 4,224,500 | A * | 9/1980 | Cruickshank et al. | 219/121.65 |
| 4,523,170 | A * | 6/1985 | Huth, III | 336/83 |
| 5,506,560 | A * | 4/1996 | Takeuchi et al. | 336/83 |
| 5,821,844 | A * | 10/1998 | Tominaga et al. | 336/110 |
| 5,912,609 | A * | 6/1999 | Usui et al. | 336/83 |
| 6,650,218 | B1 * | 11/2003 | Fushimi | 336/178 |
| 6,791,446 | B2 * | 9/2004 | Sato et al. | 336/110 |
| 7,567,161 | B2 * | 7/2009 | Monma | 336/83 |
| 2003/0184423 | A1 | 10/2003 | Holdahl et al. | |
| 2004/0189430 | A1 | 9/2004 | Matsutani et al. | |
| 2004/0209120 | A1 | 10/2004 | Inoue et al. | |

(Continued)

FOREIGN PATENT DOCUMENTS

| | | |
|---|---|---|
| CN | 1941227 | 4/2007 |
| EP | 1288975 A2 | 3/2003 |
| EP | 1288975 A3 | 4/2003 |

(Continued)

OTHER PUBLICATIONS

International Search Report and Written Opinion of PCT/US2010/033006; Jul. 15, 2010; 18 pages.

*Primary Examiner* — Mohamad Musleh
*Assistant Examiner* — Mangtin Lian
(74) *Attorney, Agent, or Firm* — Armstrong Teasdale LLP

(57) ABSTRACT

Low profile, shielded magnetic components for circuit board applications include self centering core and coil assemblies with coil receptacle and centering projections formed in core pieces that are assembled around a preformed coil. Welding and plating techniques for forming termination structure for the preformed coil avoid thermal shock issues. External gapping elements and agents to form a gapped core structure are avoided, and gap size in the cores may be tightly controlled over large production lot sizes.

19 Claims, 17 Drawing Sheets

U.S. PATENT DOCUMENTS

| | | | | |
|---|---|---|---|---|
| 2006/0186975 | A1 | 8/2006 | Wang | |
| 2006/0186978 | A1 | 8/2006 | Kawarai | |
| 2007/0057755 | A1 | 3/2007 | Suzuki et al. | |
| 2007/0273465 | A1 * | 11/2007 | Feng et al. | 336/212 |

FOREIGN PATENT DOCUMENTS

| | | | |
|---|---|---|---|
| JP | 200293634 | A | 3/2002 |
| WO | 2008152493 | A2 | 12/2008 |

* cited by examiner

MINIATURE SHIELDED MAGNETIC COMPONENT

CROSS-REFERENCE TO RELATED APPLICATION

This application claims priority to Chinese patent application number 200710111096.9, filed Jun. 15, 2007, entitled "Miniature Shielded Magnetic Component" by Yipeng Yan, Robert J. Bogert and Baoqi Wang, which is incorporated herein by reference in its entirety.

BACKGROUND OF THE INVENTION

This invention relates generally to the manufacture of electronic components, and more specifically to the manufacture of miniature magnetic components such as inductors.

DETAILED DESCRIPTION OF THE INVENTION

Figure 1:
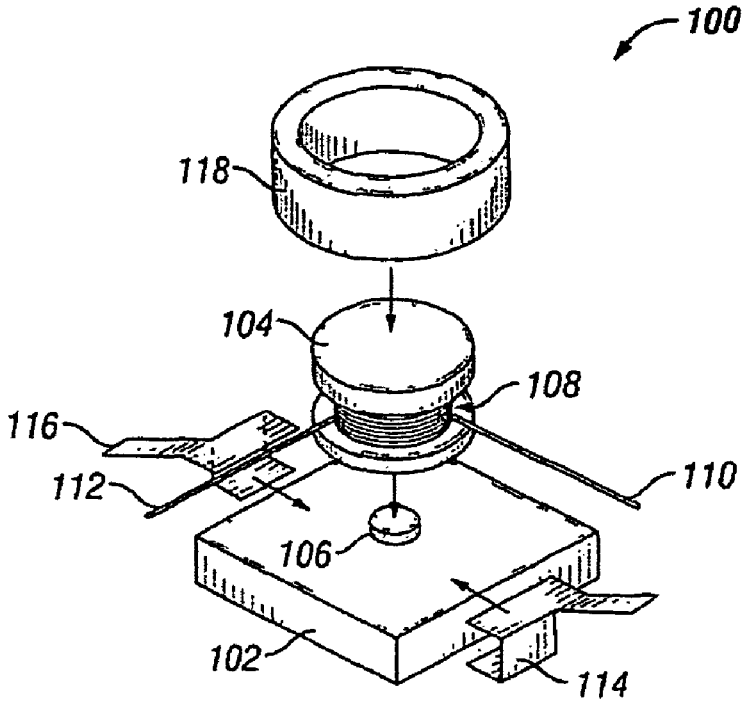
FIG. 1 (Prior Art)
FIG. 1 is a perspective view of a known magnetic component for an electronic device.

Exemplary embodiments of magnetic components are disclosed herein that overcome numerous challenges in the art for reliably manufacturing low profile components for electronic devices at a reasonable cost. More particularly, disclosed are exemplary miniature shielded power components such as inductors and transformers, and methodology for manufacturing the same. The components utilize unique core structures, preformed coils, and welding and plating techniques for forming termination structure for the preformed coil. Gap size in the cores may be tightly controlled over large production lot sizes, providing a more tightly controlled inductance value. Components may be provided at lower costs by virtue of easier assembly and better yield in comparison to known magnetic components for circuit board applications. The components also provide increased power density relative to known components, and thus the components are particularly well suited for power supply-circuitry of an electronic device.

In order to appreciate the invention to its fullest extent, the following disclosure will be segmented into different parts, wherein Part I discloses conventional shielded magnetic components and challenges associated therewith; and Part II discloses exemplary embodiments of magnetic components formed in accordance with exemplary embodiments of the present invention.

I. Introduction to the Invention

It has become desirable in many types of electronic devices to provide an ever increasing array of features and functionality in a smaller physical package size. Hand-held electronic devices such as cellular phones, personal digital assistant (PDA) devices, and personal music and entertainment devices, for example, now include an increased number of electronic components to accommodate the increased functionality desired in such devices. Accommodating an increased number of components in a reduced physical package size for such devices has led to prolific use of "low profile" components having a relatively small height projecting from a surface of a circuit board. The low profile of the components reduces a clearance needed above the board within the electronic device, and allows multiple circuit boards to be stacked within a reduced amount of space in the device.

The manufacture of such low profile components, however, presents a number of practical challenges, making it difficult and expensive to manufacture the smaller low profiles needed to produce smaller and smaller electronic devices. Producing uniform performance in very small magnetic components such as inductors and transformers is difficult, especially when the component involves gapped core structures that are difficult to control during manufacturing, resulting in performance and cost issues. In a high volume world of electronic components, any variability in performance among components is undesirable, and even relatively small cost savings can be significant.

A variety of magnetic components for circuit board applications, including but not limited to, inductors and transformers used in electronic devices, include at least one conductive winding disposed about a magnetic core. In some magnetic components, a core assembly is fabricated from ferrite cores that are gapped and bonded together. In use, the gap between the cores is required to store energy in the core, and the gap affects magnetic characteristics, including but not limited to open circuit inductance and DC bias characteristics. Especially in miniature components, production of a uniform gap between the cores is important to the consistent manufacture of reliable, high quality magnetic components.

It is therefore desirable to provide a magnetic component of increased efficiency and improved manufacturability for circuit board applications without increasing the size of the components and occupying an undue amount of space on a printed circuit board.

FIG. 1 is a perspective view of a known magnetic component 100 for an electronic device. As illustrated in FIG. 1, the component 100 is a power inductor including a base 102 fabricated from, for example a nonconductive circuit board material, such as for example, a phenolic resin. A ferrite drum core 104, sometimes referred to as a winding bobbin, is attached to the base 102 with an adhesive 106 such an epoxy-based glue. A winding or coil 108 is provided in the form of a conductive wire that is wrapped around the drum core 104 for a specified number of turns, and the winding 108 terminates at each opposing end in coil leads 110, 112 extending from the drum core 104. Metallic termination clips 114, 116 are provided on opposing side edges of the base 102 and the clips 114, 116 may be separately fabricated from a sheet of metal, for example, and assembled to the base 102. Portions of the respective clips 114, 116 may be soldered to conductive traces of a circuit board (not shown) of the electronic device, and portions of the clips 114 and 116 mechanically and electrically connect to the coil leads 110, 112. A ferrite shield ring core 118 substantially surrounds the drum core 104 and is spaced in a gapped relation to the drum core 104.

The winding 108 is wound on the drum core 104 directly, and the shield ring core 118 is assembled to the drum core 104. Careful centering of the drum core 104 with respect to the shield core 118 assembly is required to control the inductance value and ensure the DC bias performance of the conductor. A relatively high temperature soldering process is typically utilized to solder the wire leads 110, 112 to the termination clips 114, 116.

Centering of drum core 104 within shield core 118 presents a number of practical difficulties for miniaturized, low profile components. In some instances, epoxies have been used to bond the ferrite cores 104 and 118 to produce a bonded core assembly for magnetic components. In an effort to consistently gap the cores, non-magnetic beads, typically glass spheres, are sometimes mixed with adhesive insulator materials and dispensed between the cores 104 and 118 to form the gap. When heat cured, the epoxy bonds the cores 104 and 118 and the beads space the cores 104 and 118 apart to form the gap. The bond between the cores 104 and 118, however, is primarily dependant upon the viscosity of the epoxy and the epoxy to beads ratio of the adhesive mix dispensed between the cores. It has been noted that in some applications the bonded cores 104 and 118 are insufficiently bonded for their intended use, and controlling the epoxy to glass spheres ratio in the adhesive mix has proven very difficult.

Another known method of centering the drum core 104 within the shield core 118 involves a non-magnetic spacer material (not shown) that is placed between the cores 104 and 118. The spacer material is frequently made of a paper or mylar insulator material. Typically, the cores 104 and 118 and spacer material are secured to one another with tape wrapped around the outside of the core halves, with an adhesive to secure the core halves together, or with a clamp to secure the core halves and keep the gap located between the core halves. Multiple (i.e., more than two) pieces of spacer material are rarely used, since the problem of securing the structure together becomes very complicated, difficult and costly.

During the soldering process to electrically connect the coil leads 110, 112 to the termination clips 114 and 116, it has been found that cracks may develop in one or both of the drum core 104 and the shield core 118, particularly when very small cores are utilized. Additionally, electrical shorts may occur within the winding 108 during soldering processes. Either condition presents performance and reliability issues for the inductor component in use.

Figure 2:
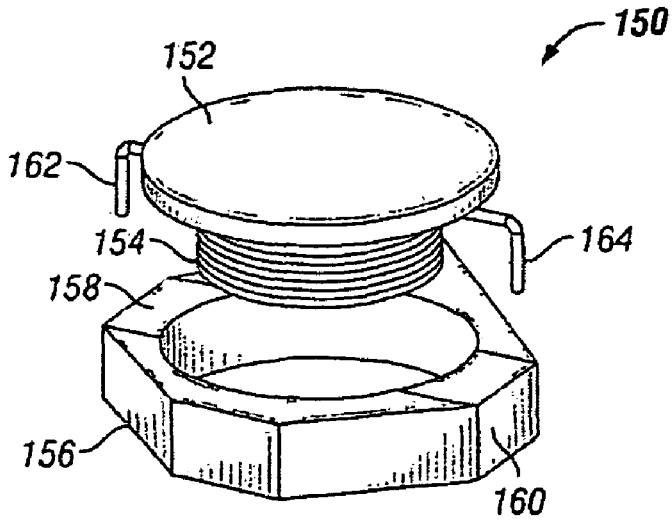
FIG. 2 (Prior Art)
FIG. 2 is an exploded view of a conventional shielded magnetic component.
Figure 3:
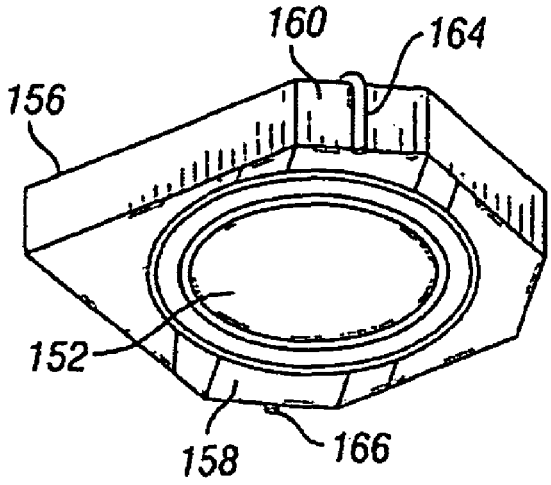
FIG. 3 (Prior Art)
FIG. 3 is a bottom assembly view of the component shown in FIG. 2

FIGS. 2 and 3 illustrate an exploded view and a perspective view, respectively, or another known type of shielded magnetic component 150 that in some aspects is easier to manufacture and assemble than the component 100 shown in FIG. 1. In addition, the component 150 may also be provided with a lower profile than the component 100.

The component 150 includes a drum core 152 upon which a coil or winding 154 is extended for a number of turns, and a shield core 156 that receives the drum core. The shield core 156 includes electroplated terminations 160 formed on the surfaces thereof. Wire leads 162, 164 extend from the winding 154 and electrically connect with the terminations 158 and 160 on side edges thereof. The electroplated terminations 160 avoid separately fabricated termination clips, such as the clips 114 and 116 as shown in FIG. 1 as well as the base 102 (also shown in FIG. 1) to which the clips 114 and 116 are assembled. Elimination of the clips 114, 116 and the base 102 that otherwise would be required saves material and assembly costs, and provides a lower profile height of the component 150 in comparison to the component 100 (FIG. 1).

The component 150, however, remains challenging to manufacture at increasingly lower profiles. Centering of drum core 152 with respect to shield core 156 remains difficult and expensive. The component 150 is also vulnerable to thermal shock, and potential damage from high temperature soldering operations to terminate the coil leads 162 and 164 to the terminations 158 and 160 on the shield core 156 during manufacture of the component 150, or thermal shock experienced when the component 150 is surface mounted to a circuit board. The thermal shock tends to reduce the structural strength of one or both cores 104, 118. With the trend toward lower profile components, the dimensions of the drum core 152 and shield core 156 are being reduced, rendering them more vulnerable to thermal shock issues. Cracking of the shield core 156 has been observed during electroplating processes to form the terminations, leading to performance and reliability issues, and undesirably low production yields of satisfactory components.

Figure 4:
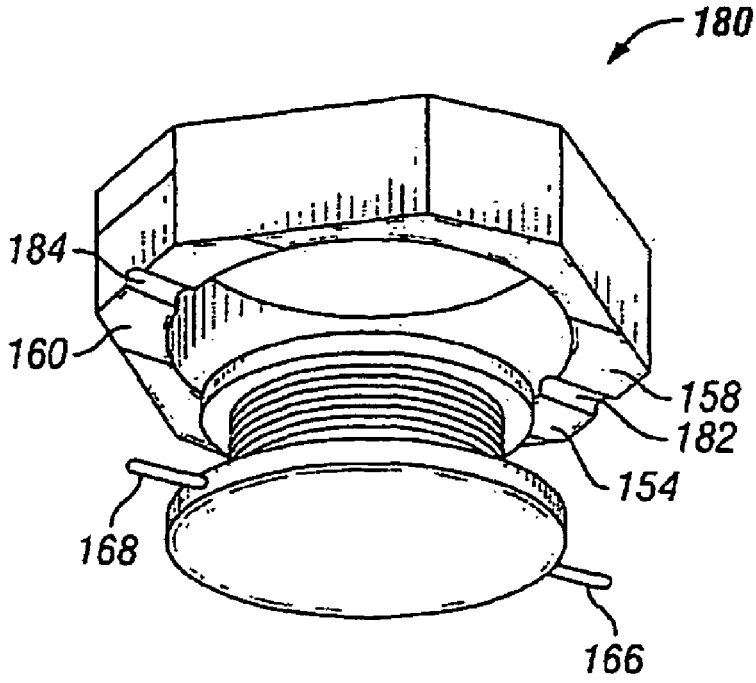
FIG. 4 (Prior Art)
FIG. 4 is an exploded view of another conventional shielded magnetic component.
Figure 5:
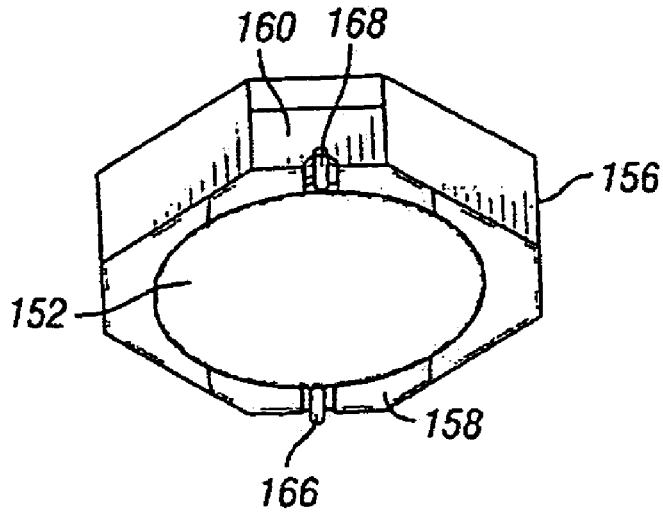
FIG. 5 (Prior Art)
FIG. 5 is a bottom assembly view of the component shown in FIG. 4.

FIGS. 4 and 5 illustrate another embodiment of a component 180 that is similar to component 150 in some aspects. Like reference characters of FIGS. 2 and 3 are used in FIGS. 4 and 5 for common features. Unlike component 150, component 180 includes termination slots 182, 184 (FIG. 4) embedded into the shield core 156. Embedded termination slots 182 and 184 receive the winding leads 166, 168 (FIG. 5) on a surface of the shield core 156, that may be surface mounted to a circuit board of an electronic device. The embedded termination slots 182 and 184 allow for a reduction of the component height, or a reduction in the profile of the component in comparison to component 150, but is still subject to the aforementioned difficulties in centering of the core, potential damage to the cores from electroplating of the terminations 158 and 160, and thermal shock issues due to high temperature soldering operations when component 180 is surface mounted to a circuit board.

Figure 6:
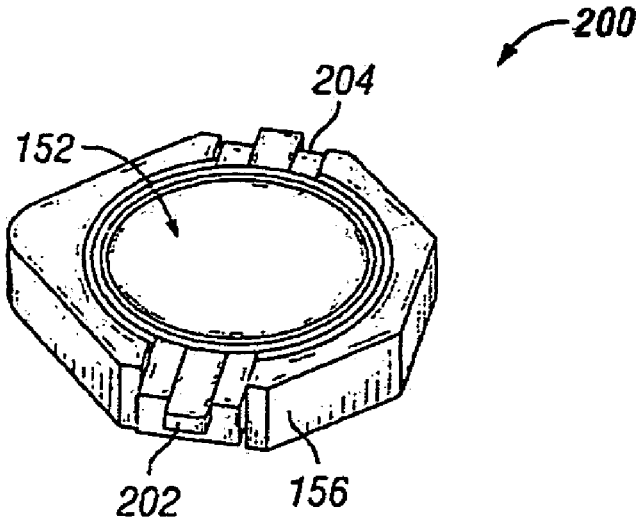
FIG. 6 (Prior Art)
FIG. 6 is a bottom assembly view of another conventional shielded magnetic component.

FIG. 6 illustrates still another known component 200 that may be constructed in accordance with either component 150 or 180, but including separately provided coil termination clips 202, 204 that more securely retain the coil leads 166, 168 (FIGS. 2-5). Clips 202, 204 are provided over the electroplated terminations 158, 160 (FIGS. 2-5) and capture the coil leads 166, 168. Aside from a more reliable termination of the coil leads 166, 168, component 200 suffers from similar difficulties in centering the drum core 154 within the shield core 156, similar issues relating to damage to the cores when electroplating the terminations, and similar thermal shock issues that may adversely impact the reliability and performance of component 200 in use.

Figure 7:
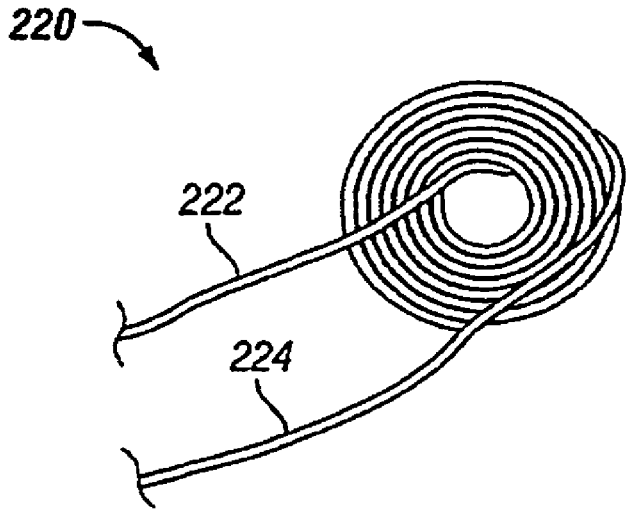
FIG. 7 (Prior Art)
FIG. 7 is a top plan view of a conventional preformed coil preformed coil for a low profile inductor component.

To avoid difficulties in winding the coil onto smaller and smaller drum cores 152 and with an eye toward further reduction of the low profile height of such components, it has been proposed to utilize preformed coil structures that, instead of being wound upon a core structure, may be separately fabricated and assembled into a core structure. FIG. 7 is a top plan view of one such conventional pre-formed coil 220 that may be used to construct a low profile inductor component. The coil 220 has first and second leads 222 and 224 and a length of wire therebetween which is wound for a number of turns. Because of the conventional manner in which the coil 220 is wound, one lead 222 extends from an inner periphery of the coil 220, and the other lead 224 extends from the outer periphery of the coil 220.

II. Exemplary Embodiments of the Invention

Figure 8:
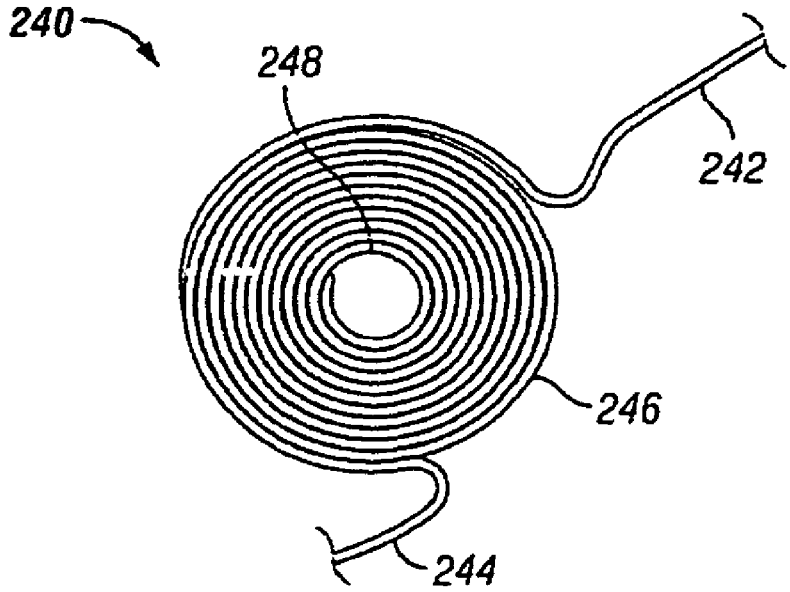
FIG. 8 is a top plan view of a coil formed in accordance with the present invention.

FIG. 8 is a top plan view of a preformed winding or coil 240 for a miniature or low profile magnetic component formed in accordance with the present invention. Like coil 220 (FIG. 7), coil 240 has first and second leads 242 and 244 and a length of wire therebetween which is wound for a number of turns to achieve a desire effect, such as, for example, a desired inductance value for a selected end use application.

In an illustrative embodiment, coil 240 may be formed from a conductive wire according to known techniques. If desired, the wire used to form coil 240 may be coated with enamel coatings and the like to improve structural and functional aspects of coil 240. As those in the art will appreciate, an inductance value of coil 240, in part, depends upon wire type, a number of turns of wire in the coil, and wire diameter. As such, inductance ratings of coil 240 may be varied considerably for different applications.

Unlike coil 220, both the leads 242 and 244 extend from an outer periphery 246 of coil 240. Stated differently, neither of leads 242 and 244 extends from an inner periphery 248 or the center opening of coil 240. Since neither lead 242 or 244 extends from the coil inner periphery 248, a winding space in a core structure (not shown in FIG. 8 but described below) may be used more effectively than with coil 220. More effective use of the winding space for coil 240 provides performance advantages and further reduction of a low profile height of a magnetic component.

Additionally, more effective use of winding space provides for additional benefits, including the use of a larger wire gauge in the fabrication of the coil while occupying the same physical area as a conventional coil fabricated from a smaller wire; gauge. Alternatively, for a given wire gauge, a greater number of turns in the coil may be provided in the same physical space that a conventional coil with a lesser number of turns would occupy by eliminating unused airspace. Still further, more effective use of winding space may reduce the direct current resistance (DCR) of component 260 in use, and reduce power losses in an electronic device.

Preformed coil 240 may be fabricated independently from any core structure, and may later be assembled with a core structure at designated stage of manufacture. The construction of coil 240 is believed to be advantageous when utilized with substantially self centering magnetic core structures as described below.

FIGS. 9-12 illustrate various views of a magnetic component 260 formed in accordance with an exemplary embodiment of the invention. Component 260 includes a first core 262, a preformed coil 240 (also shown in FIG. 8) insertable into a shield core 262, and a second core 264 overlying coil 240 and received in a self-centering manner within first core 262. First core 262 is somewhat reminiscent of the shield cores previously described, and second core 264 is sometimes referred to as a shroud that encloses coil 240 within first core 262.

Figure 9:
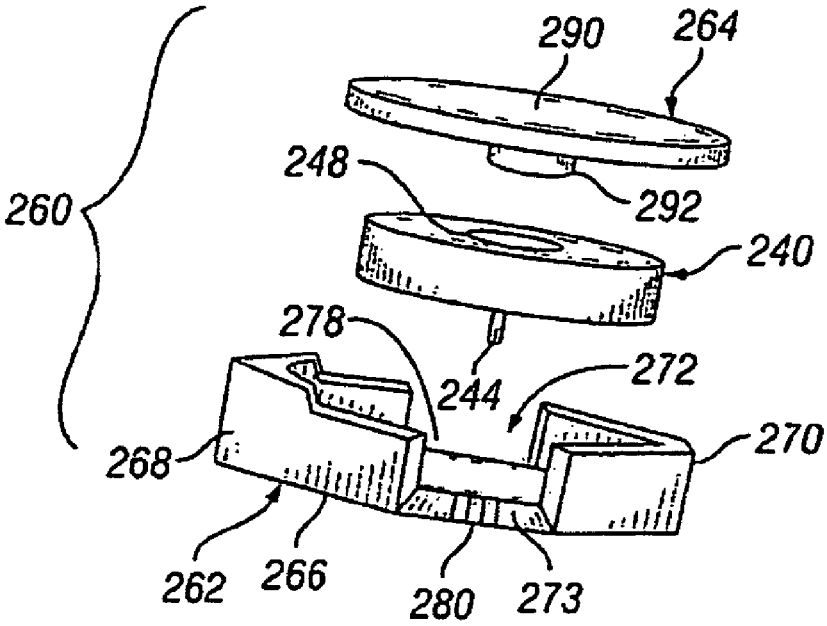
FIG. 9 is an exploded view of a component formed in accordance with an exemplary embodiment of the invention.

As best seen in FIG. 9, first core 262 may be formed from a magnetic permeable material into a solid flat base 266 with upstanding walls 268, 270 extending in a normal or generally perpendicular direction from base 266. Walls 268 and 270 may define a generally cylindrical winding space or winding receptacle 272 therebetween and above base 266 for receiving coil 240. Cutouts or openings 273 extend between the ends of the side walls 268 and 270 and provide clearances for the respective coil leads 242 and 244.

A variety of magnetic materials are known that are suitable for manufacturing core 262. For example, iron-powder cores, molypermalloy powder (MPP) having powdered nickel, iron, and molybdenum; ferrite materials; and high-flux toroid materials are known and may be used, depending on whether the component is to be used in power supply or power-conversion circuitry, or in another application such as a filter inductor, for example. Exemplary ferrite materials include manganese zinc ferrite, and particularly power ferrites, nickel zinc ferrites, lithium zinc ferrites, magnesium manganese ferrites, and the like that have been commercially used and are rather widely available. It is further contemplated that low loss powdered iron, an iron based ceramic material, or other known materials may be used to fabricate the cores while achieving at least some of the advantages of the present invention.

Figure 10:
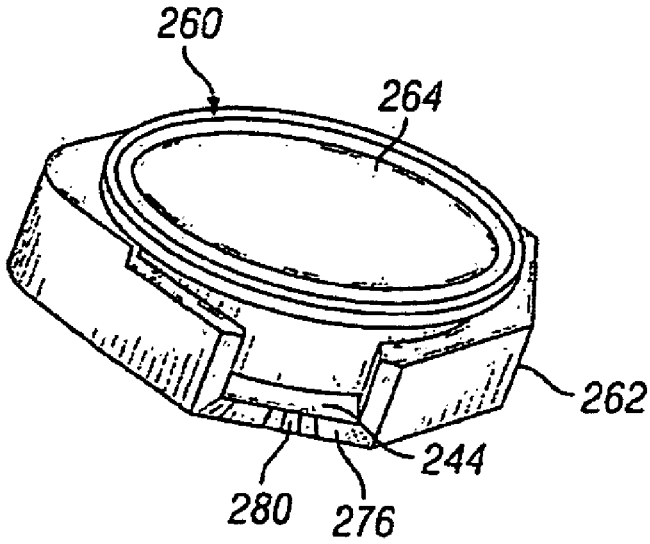
FIG. 10 is a perspective view of the component shown in FIG. 9 in an assembled condition.
Figure 11:
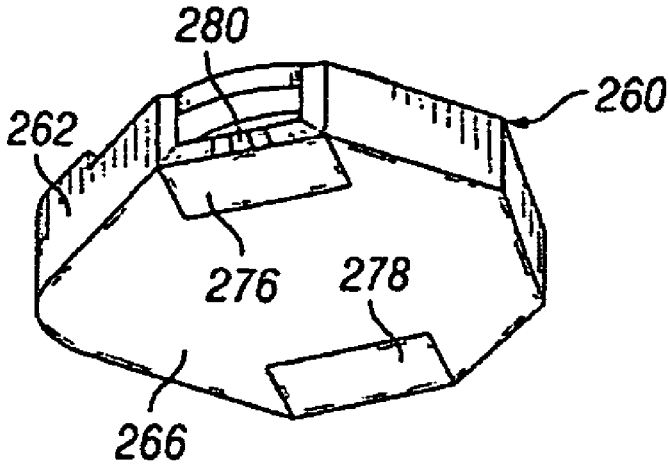
FIG. 11 is a bottom perspective view of the component shown in FIG. 10.
Figure 12:
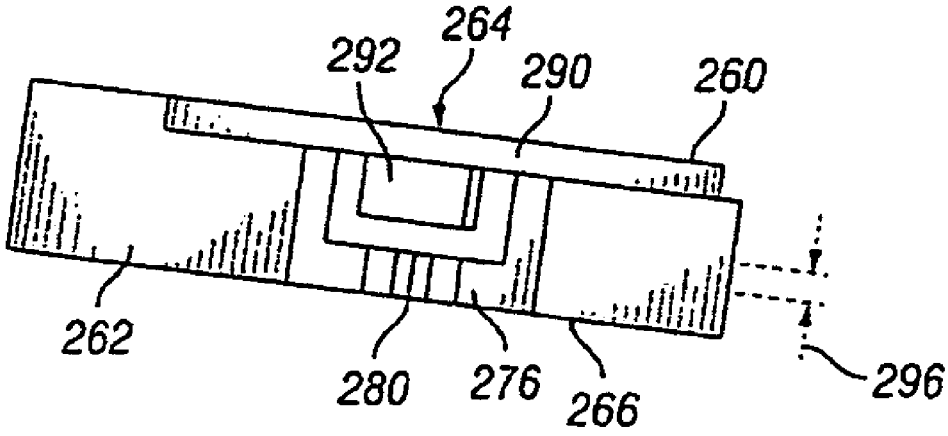
FIG. 12 is a side perspective view of the component shown in FIGS. 10-12 with parts removed.
Figure 13:
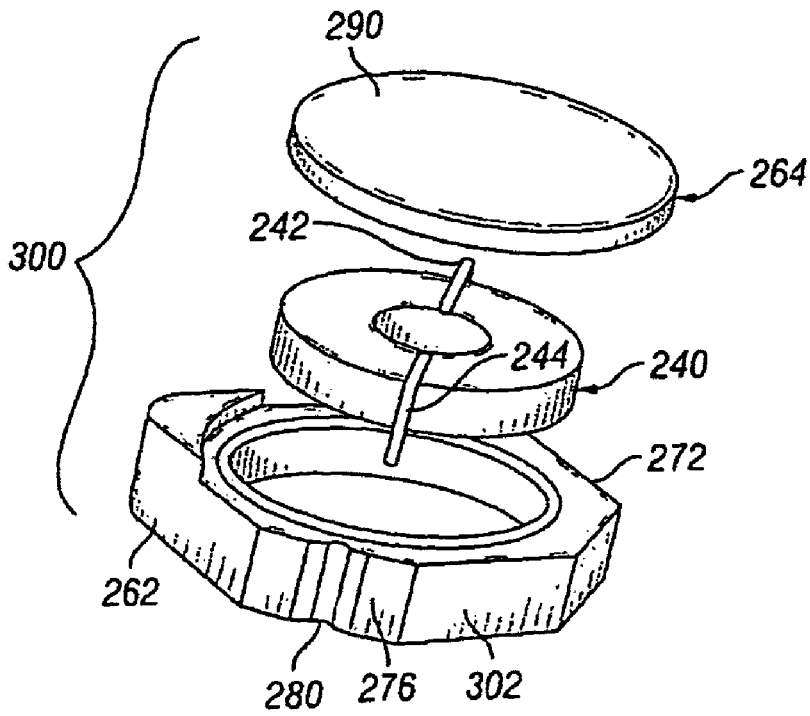
FIG. 13 is an exploded view of a component formed in accordance with another embodiment of the invention.

As shown in FIGS. 10-12, first core 262 may also include surface mount terminations 276, 278 formed on outer surfaces of first core 262. Terminations 276, 278 may be formed on core 262 from a conductive material in, for example, a physical vapor deposition (PVD) process, instead of electroplating as commonly used in the art. Physical vapor deposition permits greater process control, and enhanced quality of terminations 268, 270 on very small core structures, in comparison to conventionally used electroplating processes. Physical vapor deposition may also avoid core damage and related issues that electroplating presents. While physical vapor deposition processes are believed to be advantageous for forming terminations 268, 270, it is recognized that other termination structures may likewise be provided, including electroplated terminations, termination clips, surface terminations formed from dipping a portion of core 262 in conductive ink and the like, and other termination methods and structures known in the art.

As also shown in FIGS. 10-12, terminations 276 and 278 may each be formed with embedded termination slots 280 that receive the ends of coil leads 242 and 244. In the example shown in the Figures, as best seen in FIG. 9, the leads of coil 240 may be oriented adjacent base 266, as coil 240 is assembled to the first core 262, and the leads may be bent into engagement with terminations slots 280. Leads 242 and 244 may then be welded, for example, to terminations 276 and 278 to ensure adequate mechanical and electrical connection of coil leads 242 and 244 to terminations 276 and 278. In particular, spark welding and laser welding may be utilized to terminate coil leads 242 and 244.

Welding, as opposed to soldering, of coil leads 242 and 244 to terminations 276 and 278 avoids undesirable effects of soldering on the total height of component 260, and also avoids undesirable thermal shock issues and high temperature effects on coil 240 and potential core damage that soldering entails. Notwithstanding the benefits of welding, however, it is appreciated that soldering may be used in some embodiments of the invention while still obtaining many of the benefits of the invention.

Terminations 276 and 278 wrap around to the bottom surface of first core base 266 and provide surface mount pads for electrical connection to conductive circuit traces on a circuit board.

Second core 264 may be fabricated independently and apart from first core 262, and later assembled to first core 262 as explained below. Second core 262 may be fabricated from a magnetic permeable material, such as those described above, into a generally flat, disk-shaped main body 290 having a first diameter and a centering projection 292 integrally formed with the main body 290 and extending outwardly from one side thereof. Centering projection 292 is centrally located on main body 290 and may be formed, for example, into a generally cylindrical plug or post having a smaller diameter than main body 290. Further, post 292 may be dimensioned to closely match but be received within inner periphery 248 of coil 240. Post 292 therefore may serve as an alignment or centering feature of second core 264 when component 260 is assembled. Post 292 may be extended into the opening of the coil at coil inner periphery 248, and outer periphery of the main body 290 may be seated against an upper surface of the side walls 268, 270 of first core 262. When cores 262 and 264 are bonded together using, for example, an epoxy based adhesive, coil 240 is sandwiched between cores 262 and 264 and maintained in its position by post 292 of second core 264.

Especially when the outer periphery of coil 240 (indicated by reference numeral 246 in FIG. 8) is closely matched to the inner dimensions of receptacle 272 in first core 262, the interfitted assembly of cores 262 and 264 and coil 240 provides a particularly compact and mechanically stable component 260 in which external centering elements are not required. Independent and separate fabrication of cores 262 and 264 and preformed coil 240 provides ease of assembly and simplified manufacturing of component 260, as opposed to conventional component assemblies wherein the coil is directly wound on a small core structure.

As best seen in FIG. 12 (in side view wherein coil 240 is not shown), post 292 of second core 264 extends only part of the distance from the main body 290 to the base 266 of first core 262 through coil inner periphery 248 (FIG. 9). That is, an end of post 292 does not extend to, and is spaced from, base 266 of first core 262 to provide a physical core gap 296. Physical gap 296 allows energy storage in the cores, and affects magnetic characteristics of component 260 such as open circuit inductance and DC bias characteristics. By providing gap 296 between post 292 and base 266, stable and consistent manufacture of gap 296 across a large number of components 260 is provided in a straightforward and relatively low cost manner in comparison to conventional low profile magnetic components for electronic devices. The inductance value for component 260 can therefore be tightly controlled at relatively low cost in comparison to existing component constructions. Higher production yields of acceptable components results from greater process control.

FIGS. 13-16 illustrate in various views another component 300 component formed in accordance with another embodiment of the invention. Component 300 in many aspects is similar to component 260 described above in relation to FIGS. 9-12, and like reference characters are therefore used in FIGS. 14-16 to indicate common features. Except as noted below, component 300 is substantially identical in its construction to component 260 and provides substantially similar benefits.

Figure 14:
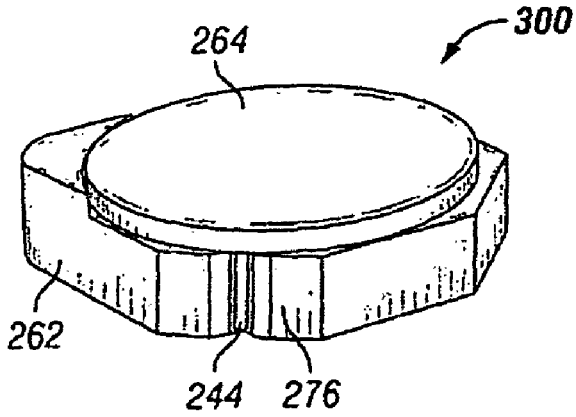
FIG. 14 is a perspective view of the component shown in FIG. 13 in an assembled condition.
Figure 15:
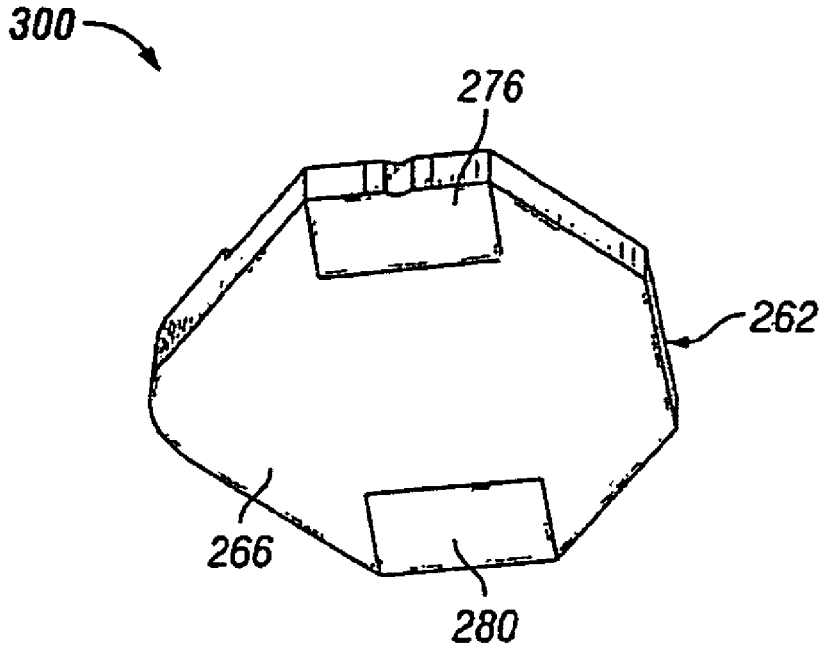
FIG. 15 is a bottom perspective view of the component shown in FIG. 14.
Figure 16:
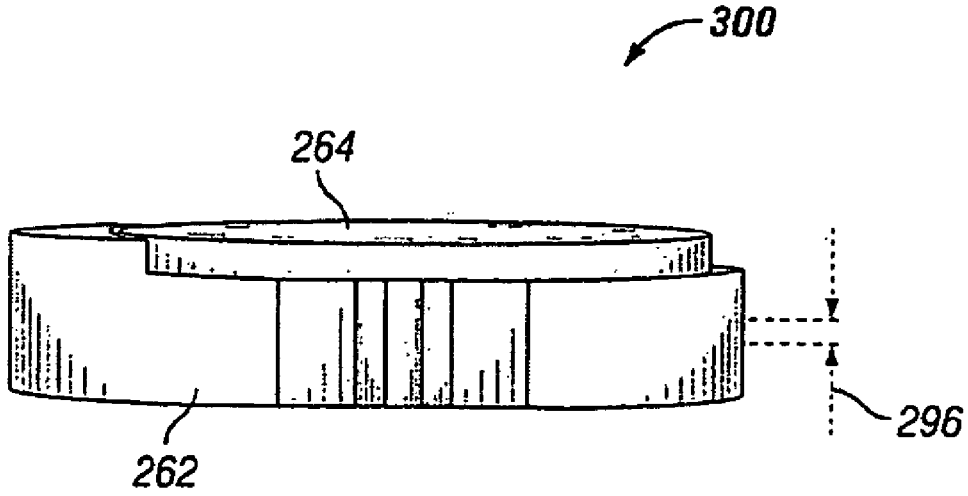
FIG. 16 is a side schematic view of the component shown in FIGS. 13-15.
Figure 17:
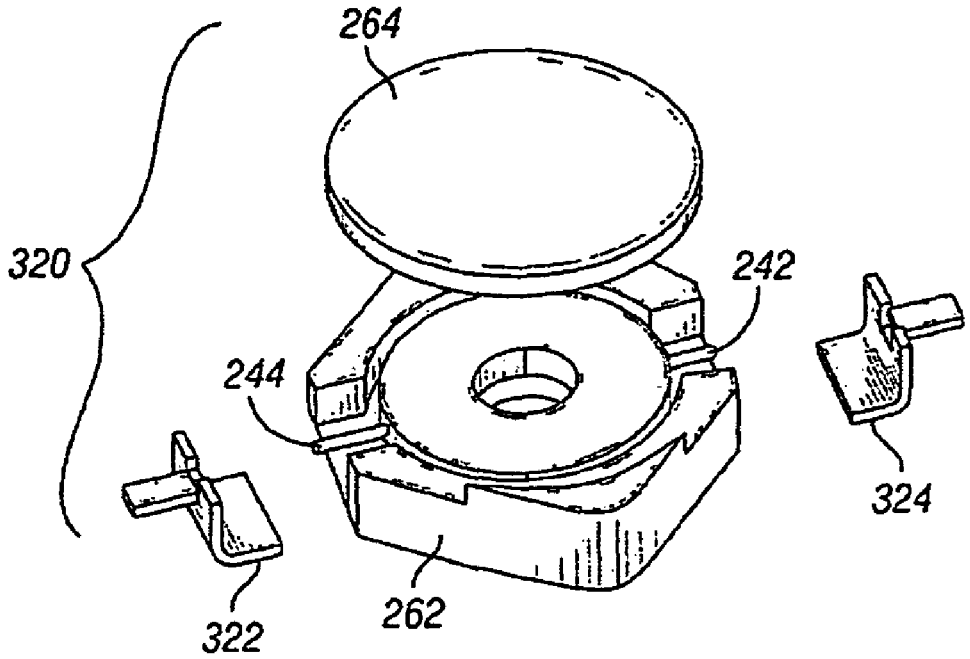
FIG. 17 is a partial exploded view of another component formed in accordance with an exemplary embodiment of the invention.
Figure 18:
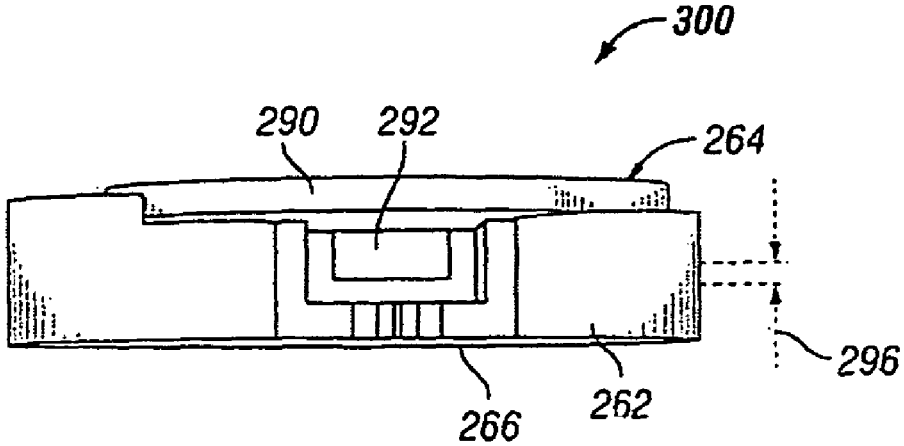
FIG. 18 is a side perspective view of the component shown in FIG. 17 with parts removed.
Figure 19:
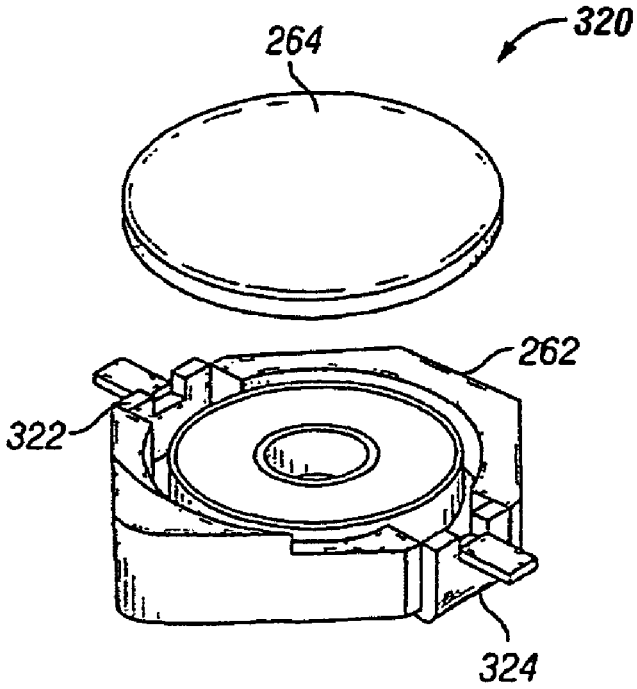
FIG. 19 illustrates the component shown in FIG. 17 in a partly assembled condition.
Figure 20:
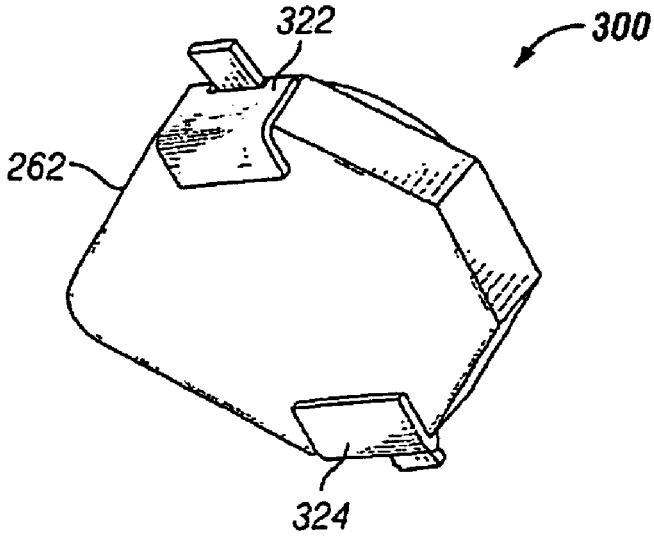
FIG. 20 illustrates a bottom perspective view of the component shown in FIG. 19.
Figure 21:
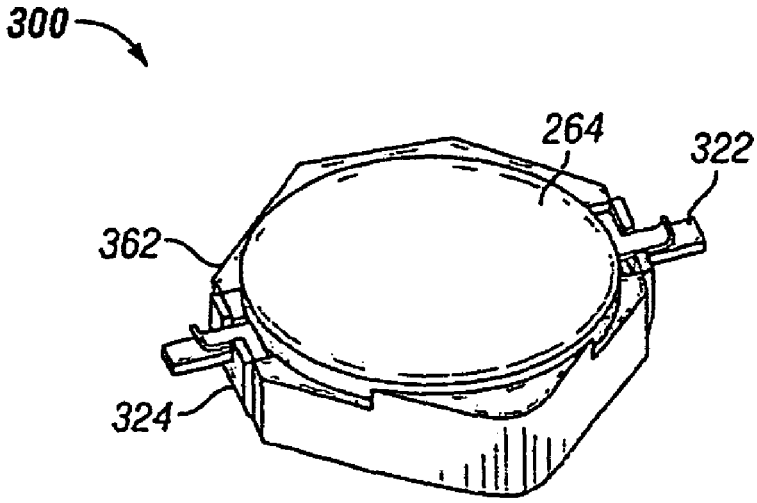
FIG. 21 is a top perspective view of the component shown in FIG. 17 in a fully assembled condition.
Figure 22:
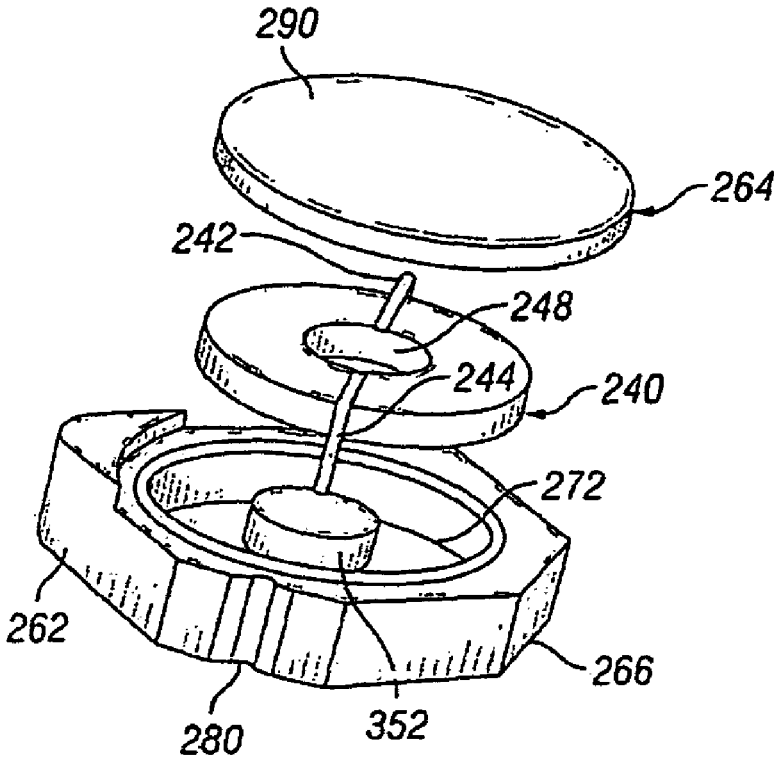
FIG. 22 is a perspective view of still another magnetic component formed in accordance with another exemplary embodiment of the invention.
Figure 23:
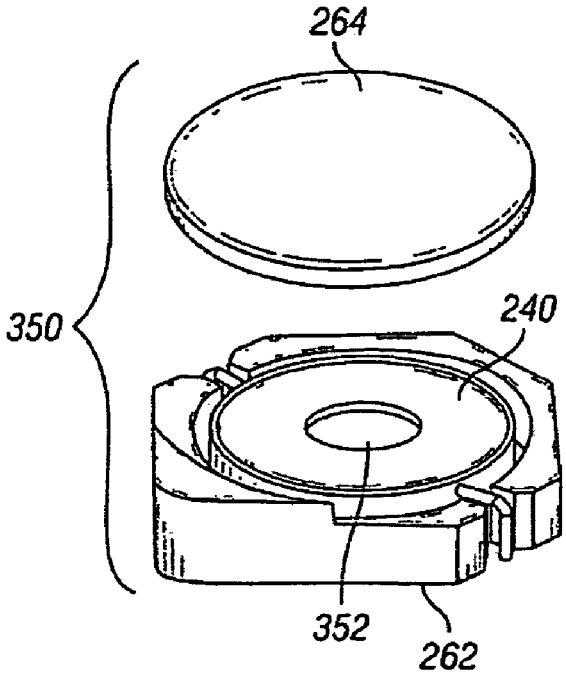
FIG. 23 illustrates the component shown in FIG. 22 at another stage of manufacture.
Figure 24:
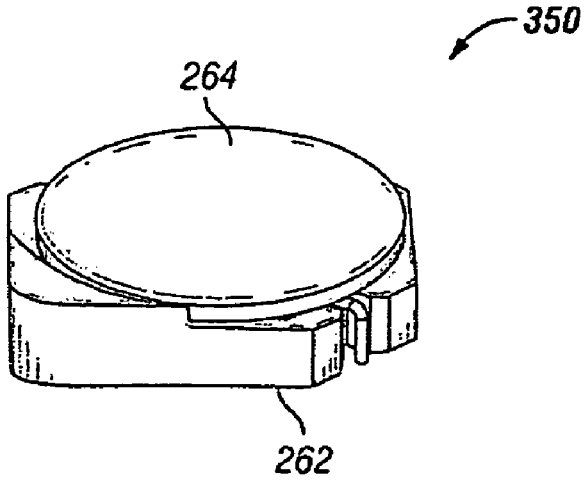
FIG. 24 is a top perspective view of the component shown in FIG. 23 in a fully assembled condition.
Figure 25:
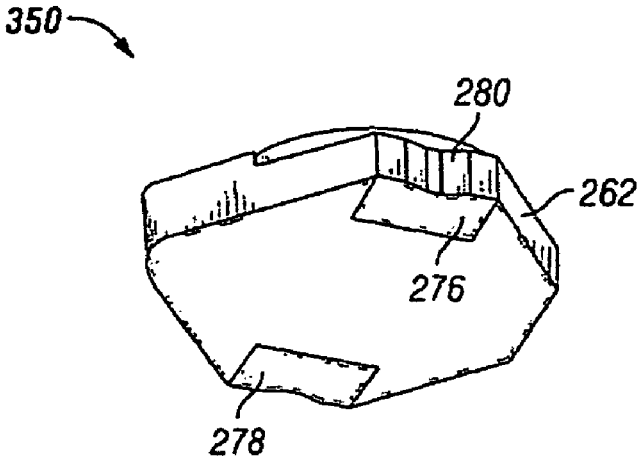
FIG. 25 is a bottom perspective view of the component shown in FIG. 23.
Figure 26:
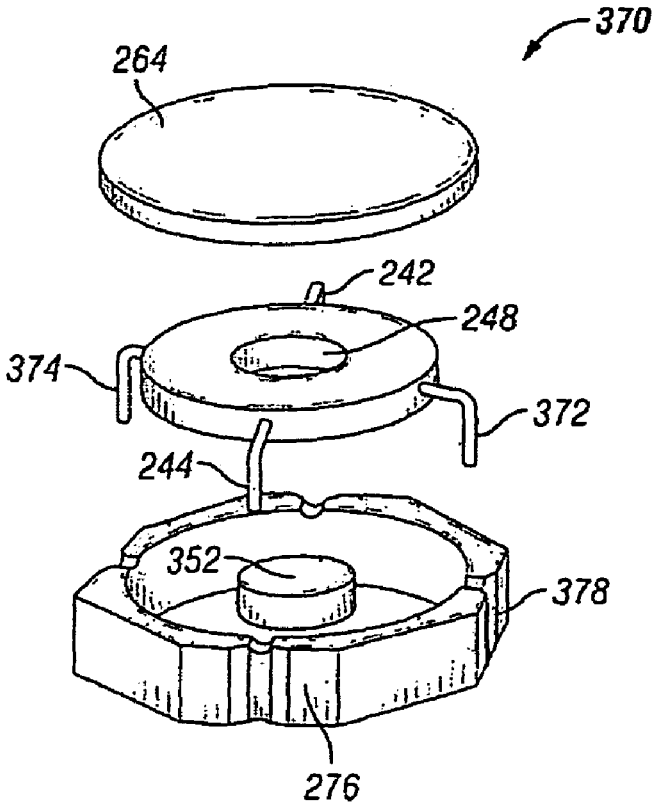
FIG. 26 is a perspective view of still another magnetic component formed in accordance with another exemplary embodiment of the invention.
Figure 27:
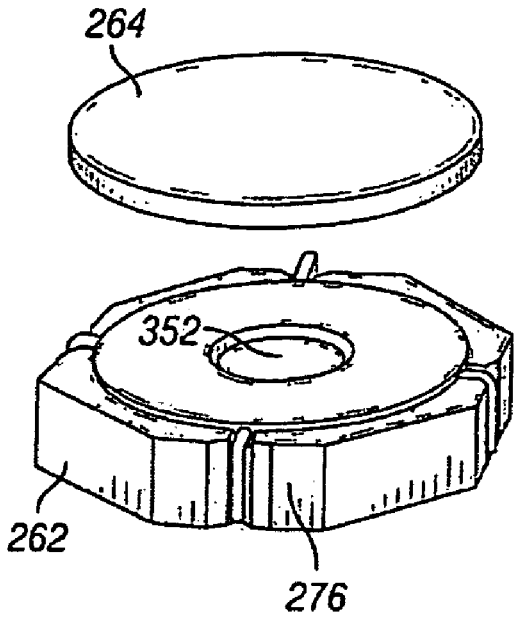
FIG. 27 illustrates the component shown in FIG. 26 at another stage of manufacture.
Figure 28:
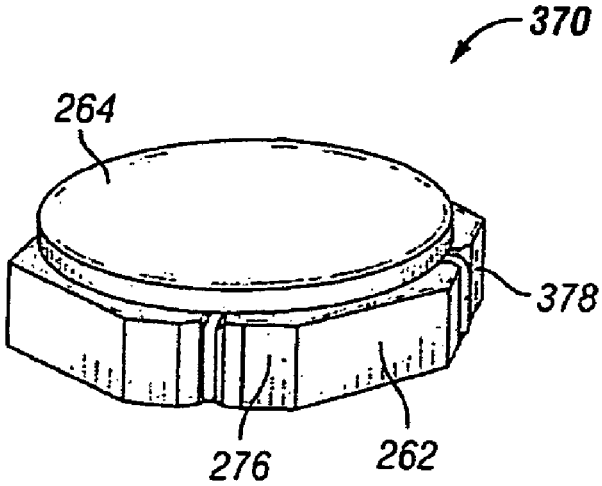
FIG. 28 is a top perspective view of the component shown in FIG. 26 in a fully assembled condition.
Figure 29:
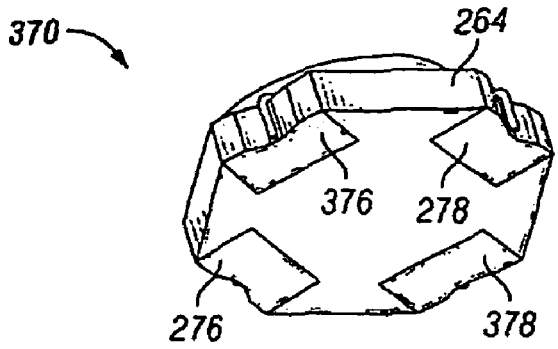
FIG. 29 is a bottom perspective view of the component shown in FIG. 28.

First core 262 of component 300, unlike component 260, is formed with a substantially solid and continuous side wall 302 that defines receptacle 272 for preformed coil 240. That is, component 300 does not include cutouts 273 shown in FIG. 9 in first core 262. Also, as best shown in FIG. 14, coil 240 is oriented with leads 242, 244 extending from an upper surface of coil 240, rather than in the configuration shown in FIG. 9 wherein the leads are positioned on the bottom surface of coil 240 adjacent base 266. By virtue of the orientation of coil 240 and solid wall 302 without cutouts, termination slots 280 in terminations 276 and 278 extend the entire height of first core 162, as opposed to the embodiment shown in FIG. 9 wherein termination slots 280 extend only for the height of the base 266. Elongation of terminations 276 and 278 and slots 280 for the entire height of wall 302 provides an increased bonding area for coil leads 242 and 244 on terminations 276 and 278, and may facilitate soldering or welding operations to secure coil leads 242 and 244 to terminations 276, 278 of first core 262.

FIGS. 17-21 illustrate in various views another component 320 component formed in accordance with another embodiment of the invention. Component 320 in many aspects is similar to component 260 described above in relation to FIGS. 9-12, and like reference characters are used in FIGS. 17-21 for common features. Except as noted below, component 320 is substantially identical in its construction to component 260 and provides substantially similar benefits.

As shown in FIGS. 17-22, component 320 includes preformed conductive termination clips 322 and 324 that are independently fabricated from core 262 into freestanding structures that are assembled to core 262. Clips 322 and 324 may be fabricated, for example, from conductive sheets of material, and stamped, bent or otherwise formed into a desired shape. Termination clips 322 and 324 provide for termination of coil leads 242 and 244 as well as surface mount termination pads for a circuit board. Clips 322 may be used in lieu of, or in addition to, terminations 276, 278 described above.

FIGS. 22-25 illustrate various views of still another magnetic component 350 formed in accordance with another exemplary embodiment of the invention. Component 350 in many aspects is similar to component 260 described above in relation to FIGS. 9-12, and like reference characters are used in FIGS. 22-25 for common features. Except as noted below, component 350 is substantially identical in construction to component 350 and provides substantially similar benefits.

Unlike component 260, component 360 includes a centering projection or post 352 formed in first core 262 instead of second core 264, as described above. Post 352 may be centrally located in receptacle 272 of first core 262 and may extend upwardly from base 266 of first core 262. As such, post 352 may extend upwardly into inner periphery 248 of coil 240 to maintain coil 240 in a fixed, predetermined and centered position with respect to core 262. Core 264, however, includes only main body 290. That is, core 264 does not include post 292 shown in FIGS. 9 and 12 in an exemplary embodiment.

Post 352 may extend only a portion of the distance between base 266 of first core 262 and main body 292 of core 264, and thus a gap may be provided between an end of post 352 and core 264 in a consistent and reliable manner. A non-magnetic spacer element (not shown) fabricated from, for example, a paper or mylar insulator material may be provided on the upper surface of core 262 and core 264 and extend between cores 262 and 264 to lift and separate core 262 from post 352 to define the gap in whole or in part if desired. Otherwise, post 264 may be formed to have a comparatively lower height than the side wall of core 262 that defines receptacle 272, thereby resulting in a physical gap between post 352 and core 264 when the component is assembled.

In a further and/or alternative embodiment, each of core 262 and core 264 may be formed with a centering projection or post, with the dimensions of the posts being selected to provide a gap between the ends of the posts. A spacer element may be provided to define the gap in whole or in part in such an embodiment.

FIG. 26-29 illustrate various views of another magnetic component 370 formed in accordance with another exemplary embodiment of the invention. Component 370 in many aspects is similar to component 350 described above in relation to FIGS. 22-25, and like reference characters are used in FIGS. 26-29 for common features. Except as noted below, component 370 is substantially identical in its construction to the component 350 and provides substantially similar benefits.

Coil 240 in component 370 includes multiple windings each associated with a pair of leads. That is, first and second coil leads 242 and 244 are provided to terminate and electrically connect a first set of winding turns in coil 240, and third and fourth coil leads 372 and 374 are provided to terminate and electrically connect a second set of winding turns in coil 240. Accordingly, core 262 is provided with terminations 276 and 278 for first and second coil leads 242 and 244, respectively, and core 262 is provided with terminations 376 and 378 for third and fourth coil leads 372 and 374, respectively. Additional coil leads and terminations may be provided to accommodate additional winding sets in coil 240.

Multiple winding sets in coil 240 may be especially beneficial when coupled inductors are desirable, or for the manufacture of transformers such as gate drive transformers and the like.

Figure 30:
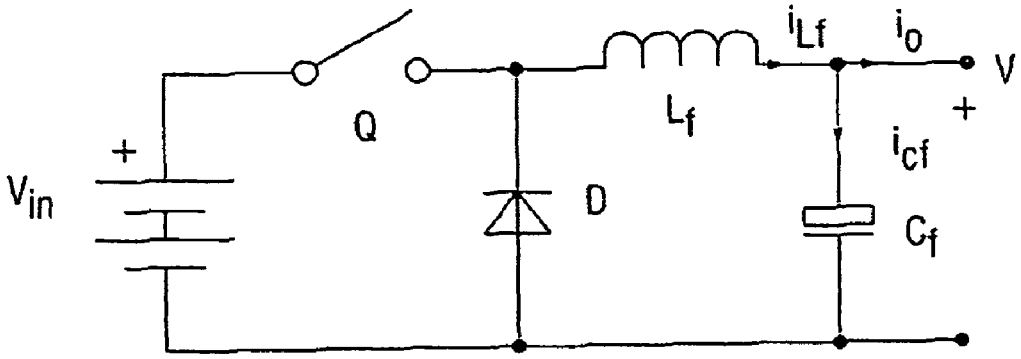
FIG. 30 is a basic circuit diagram for a step down converter.
Figure 31:
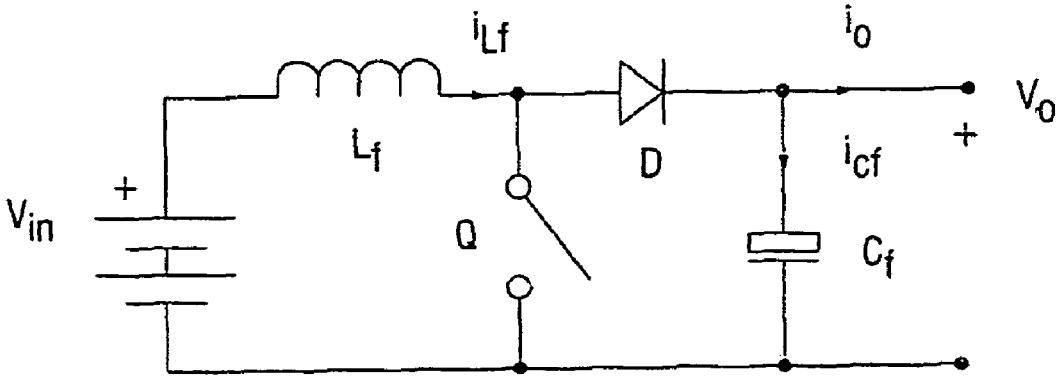
FIG. 31 is a basic circuit diagram for a step up converter.
Figure 32:
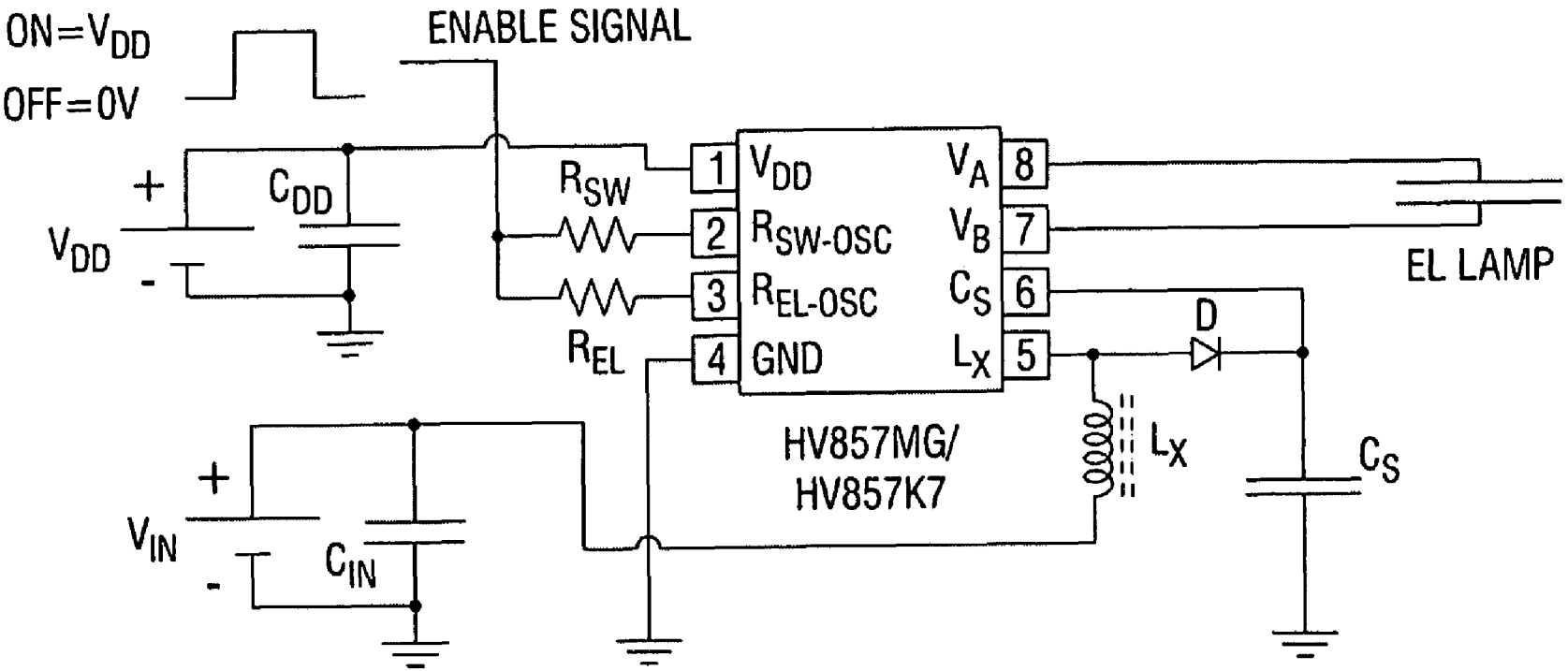
FIG. 32 is a circuit diagram for a high voltage driver.

The inductors provided herein may be used in a variety of devices, such as for example, step down or step up converters. For example, FIG. 30 illustrates a typical circuit diagram for a step down or buck converter, and FIG. 31 illustrates a typical circuit diagram for a step up or boost converter. Inductors prepared in accordance with the present invention may be also used in a variety of electronic devices, such as for example, mobile phones, PDA and GPS devices, and the like. In one exemplary embodiment, as shown in the circuit diagram provided in FIG. 32, an inductor prepared in accordance with methods described herein may be included in a high voltage driver designed for driving electroluminescent lamps used in electronic devices, such as for example, mobile phones.

Figure 33:
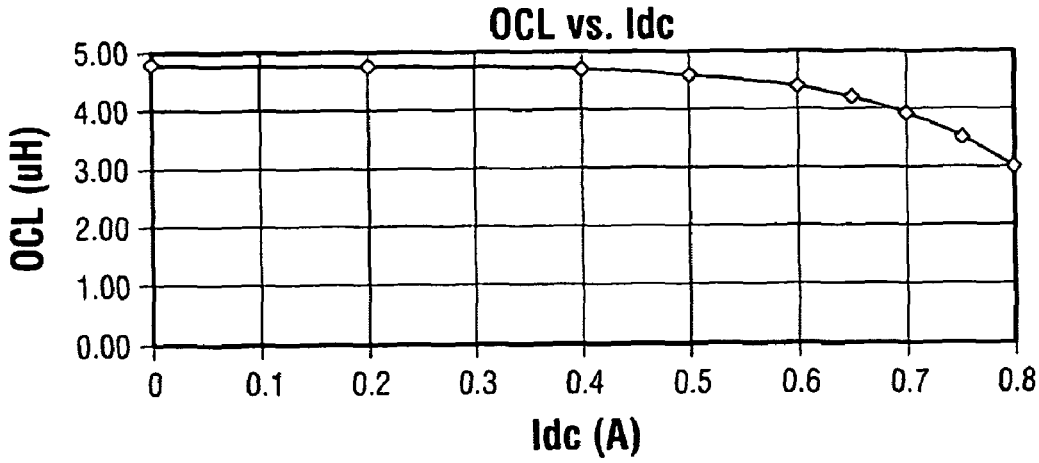
FIG. 33 is a graph showing inductance vs. current performance for an exemplary device.
Figure 34:
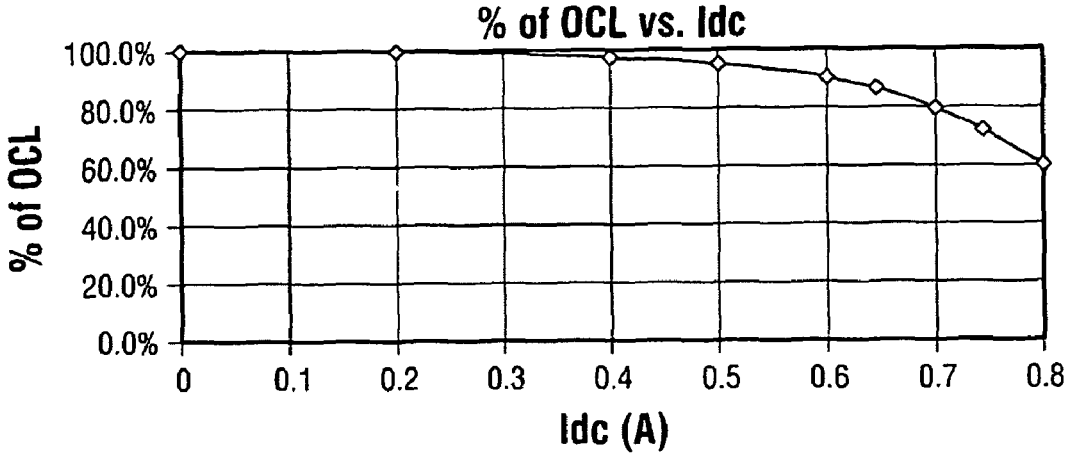
FIG. 34 is a graph showing inductance rolloff for an exemplary device.

In an exemplary embodiment, an inductor is provided having dimensions of 2.5 mm.times.2.5 mm.times.0.7 mm. Peak inductance for the exemplary device is 4.7.mu.H.+–0.20%, with a peak current of 0.7 A and an average current of 0.45 A. Resistance of the wire is measured at 0.83 ohms. The characteristics of the Exemplary device are compared against two competitor devices, as shown in Table 1. Comparative Example 1 is a Murata inductor, model number LQH32CN and Comparative Example 2 is a TDK inductor, model number VLF3010AT-4R7MR70. As shown in the table, the exemplary inductor (Example 1) provides the same performance in terms of inductance and peak current from a much smaller package. Performance of Example 1 is shown in FIG. 33 where the inductance is shown as a function of current. Roll off (percent loss of inductance with increasing current) for the inductor of Example 1 is shown in FIG. 34 and is approximately 20% at the peak current value of 0.7 A.

TABLE 1

| Sample | Device Dimensions (L × W × H) | Max Inductance (μH) | Peak Current ($I_{sat}$) | Average Current ($I_{rms}$) | Direct Current Resistance |
|---|---|---|---|---|---|
| Example 1 | 2.5 mm × 2.5 mm × 0.7 mm | 4.7 ± 20% | 0.7 A | 0.46 A | 0.83 Ohms |
| Comparative Example 1 | 3.2 mm × 2.5 mm × 1.56 mm | 4.7 ± 20% | 0.65 A | — | 0.195 Ohms |
| Comparative Example 2 | 2.8 mm × 2.6 mm × 1.0 mm | 4.7 ± 20% | 0.7 A | 0.82 A | 0.24 Ohms |

III. Conclusion

The benefits and advantages of the invention are now believed to be amply demonstrated in the above-described embodiments. The unique core structures, preformed coils, and welding and plating techniques for forming termination structure for the preformed coil avoid thermal shock issues to which conventional component constructions are susceptible, avoid external gapping elements and agents to form a gapped core structure, and permit gap size in the cores to be tightly controlled over large production lot sizes to provide a more tightly controlled inductance value for the components. The components may be provided at lower costs by virtue of easier assembly and better yield in comparison to known magnetic components for circuit board applications.

While various embodiments have been disclosed, it is contemplated that still other variations and adaptations of the exemplary embodiments disclosed herein are within the purview of those in the art without departing from the scope and spirit of the invention. For example, distributed air gap core materials having, for example, a powdered iron and resin binder mixed with one another on a particle level, thereby producing a gap effect without formation of a discrete gap in the structure are also available and may be utilized to produce largely self centering core and coil constructions without a discrete physical gap to simplify the manufacturing process further, and potentially to improve the DC bias characteristics and reduce the AC winding loss of the component.

A low profile magnetic component has been described that includes a first core fabricated from a magnetic permeable material and includes a receptacle therein, and a second core fabricated from a magnetic permeable material, wherein the second core is fabricated independently from the first core. The component further includes a coil formed independently from the first and second cores, wherein the coil includes at least a first lead, a second lead and plurality of turns therebetween. The first core includes a receptacle adapted to receives the coil, and at least one of the first and second cores includes a projection fitted into the coil.

In one embodiment, the projection extends from the second core into a center opening of the coil. In another embodiment, the projection extends into the receptacle a length less than the distance between the first and second cores when said cores are assembled, thereby forming a gap between the first and second cores. In another embodiment, the first core includes the projection extending through a center opening of the coil. In yet another embodiment, the projection extends from a base of the first core, such that the post is spaced from the second core when the first and second cores are assembled.

In another embodiment, the first core includes surface mount terminations for the coil leads. In another embodiment, the component also includes first and second conductive clips adapted to receive the first and second coil leads, respectively. In another embodiment, the coil further includes third and fourth leads. In another embodiment, the coil includes an inner periphery and an outer periphery, wherein each of the first and second leads connect to the coil at the outer periphery. Such low profile magnetic component can be used as a power inductor.

In another aspect, a low profile magnetic component has been described that includes a first core fabricated from a magnetic permeable material and having a receptacle formed therein. The component includes a preformed coil received in the receptacle of the first core, wherein the coil includes at least a first lead, a second lead and plurality of turns therebetween. The component also includes a second core fabricated from a magnetic permeable material, the second core fabricated independently from the first core, and including a post extending through a center opening of the coil and establishing a gap with the first core.

In one embodiment, the first core includes surface mount terminations for the coil leads. In another embodiment, the component further includes first and second conductive clips receiving the first and second coil leads, respectively. In another embodiment, the coil further comprises third and fourth leads. In yet another embodiment, the coil includes an inner periphery and an outer periphery, and the first and second leads connect to the coil at the outer periphery. In yet another embodiment, the first core includes a base and upstanding side walls extending from the base, and a gap extends between the base and a distal end of the post. In another embodiment, the post is substantially cylindrical. In another embodiment, the first core further includes a main body overlying the coil, the main body having an outer periphery larger than the post.

In another aspect, a low profile magnetic component has been described that includes a first core fabricated from a magnetic permeable material, wherein the first core includes a receptacle and a post projecting upwardly into the receptacle. The component includes a preformed coil received in the receptacle of the first core and on the post extending through an inner periphery of the coil. The coil includes at least a first lead, a second lead and plurality of turns therebetween.

In one embodiment, the component includes a second core fabricated form a magnetic permeable material, wherein the second core is fabricated independently from the first core and overlying the coil. In another embodiment, the second core includes a substantially flat body having an outer periphery larger than the post. In another embodiment, the first core includes surface mount terminations for the coil leads. In another embodiment, the component includes first and second conductive clips mounted to the first core and receiving the first and second coil leads, respectively. In another embodiment, the coil further comprises third and fourth leads. In another embodiment, the coil includes an inner periphery and an outer periphery, wherein each of the first and second leads connect to the coil at the outer periphery. In another embodiment, the component is a power inductor. In another embodiment, the first core includes a base and upstanding side walls extending from the base, and a gap extends between the second core and a distal end of the post.

In another aspect, a low profile magnetic component which includes a preformed coil, first means for providing a first magnetic core and for receiving the preformed coil and second means for providing a second magnetic core. The second means are provided separate from the means for providing a first magnetic core and enclosing the preformed coil within the first means. The component also includes means for centering the coil with respect to the core, the centering means being integrally provided in one of the first and second magnetic cores for providing a magnetic core.

In another aspect, a method of manufacturing a low profile magnetic component has been described which includes the steps of: (a) providing a first core fabricated from a magnetic permeable material, wherein the first core includes a receptacle; (b) providing a second core fabricated from a magnetic permeable material, wherein the second core is fabricated independently from the first core; and (c) providing a coil formed independently from the first and second cores, wherein the coil includes, first and second leads and a plurality of turns therebetween, and wherein the receptacle formed in the first core receives the coil and at least one of the first and second cores include a projection fitted into the core.

In another aspect, a low profile magnetic component has been described that includes a first core, wherein the first core is fabricated from a magnetic permeable material. The first core includes a receptacle formed therein. The magnetic component also includes a second core, wherein the second core is fabricated from a magnetic permeable material and is fabricated independent from said first core. The component includes a coil formed independent from the first and second cores, wherein the coil includes a first lead, a second lead, and a plurality of turns therebetween. The coil includes an inner periphery and an outer periphery, wherein the first and second leads connect to the coil at the outer periphery. The component also includes first and second conductive clips for receiving the first and second leads, respectively. The receptacle formed in the first core is adapted to receive the coil and wherein at least one of the first core and the second core include a projection, said projection adapted to be inserted into the coil.

While the invention has been described in terms of various specific embodiments, those skilled in the art will recognize that the invention can be practiced with modification within the spirit and scope of the claims.

What is claimed is:

1. A low profile magnetic component comprising:

a first core fabricated from a magnetic permeable material and defining a receptacle;

a second core fabricated from a magnetic permeable material, the second core fabricated independently from the first core and having a different shape than the first core; and a single coil formed independently from the first and second cores, the single coil defined by a first lead, a second lead and plurality of turns forming a single winding between the first lead and the second lead;

wherein the first core defines a receptacle that receives substantially all of the turns of the single coil, and at least one of the first and second cores comprises a projection fitted into the single coil, wherein a non-magnetic gap extends between the projection and a portion of the first core;

wherein the second core is bonded to the first core in a stationary position relative to the first core; and wherein the first core comprises surface mount terminations for the first and second leads of the single coil; and wherein the single coil comprises an inner periphery and an outer periphery, wherein each of the first and second leads connect to the single coil at the outer periphery.

2. The low profile magnetic component of claim 1, wherein the second core defines the projection, the projection extending into a center opening of the single coil.

3. The low profile magnetic component of claim 1, wherein the projection extends less than the distance between the first and second cores when said cores are assembled, thereby forming a physical gap between the first and second cores.

4. The low profile magnetic component of claim 1, wherein the first core defines the projection, the projection extending through a center opening of the single coil.

5. The low profile magnetic component of claim 1, wherein the projection comprises a post extending from a base of the first core, the post being spaced from the second core when the first and second cores are assembled.

6. The low profile magnetic component of claim 1, further comprising first and second conductive clips receiving the first and second coil leads, respectively.

7. The low profile magnetic component of claim 1, wherein the component is a power inductor.

8. A low profile inductor component comprising:

a first core fabricated from a magnetic permeable material and defining a receptacle;

a preformed coil received in the receptacle of the first core, the coil comprising at least a first lead, a second lead and plurality of turns therebetween wherein substantially all of the turns are received in the receptacle; and a second core fabricated from a magnetic permeable material and being differently shaped from the first core, the second core fabricated independently from the first core, said second core comprising a post extending through a center opening of the coil and establishing a physical gap with the first core, wherein energy is stored in the gap as current flows through the plurality of turns;

wherein the first core comprises surface mount terminations for the first and second leads; wherein the coil comprises an inner periphery and an outer periphery, wherein the first and second leads connect to the coil at the outer periphery.

9. The low profile inductor component of claim 8, further comprising first and second conductive clips receiving the first and second coil leads, respectively.

10. The low profile inductor component of claim 8, wherein the component is a power inductor.

11. The low profile inductor component of claim 8, wherein the first core comprises a base and upstanding side walls extending from the base, and wherein the physical gap extends between the base and a distal end of the post.

12. The low profile inductor component of claim 8, wherein the first core further comprises a main body overlying the coil, the main body having an outer periphery larger than the post.

13. The low profile inductor component of claim 8, wherein the post is substantially cylindrical.

14. A low profile magnetic component comprising:

a preformed coil defining a plurality of turns;

first means for providing a first magnetic core and for receiving substantially all of turns of the preformed coil; and second means for providing a second magnetic core, the second means separately provided from the means for providing a first magnetic core and enclosing the preformed coil within the first means; and means for centering the coil with respect to at least one of the first magnetic core and the second magnetic core, the centering means being integrally provided in one of the first and second magnetic cores for providing a magnetic core;

means for defining a non-magnetic gap between the means for centering and one of the first magnetic core and the second magnetic core, the non-magnetic gap providing energy storage when electrical current flows through the plurality of turns; and means for defining surface mount terminations; wherein the coil comprises a first lead, a second lead, an inner periphery and an outer periphery, and wherein each of the first and second leads connect to the coil at the outer periphery.

15. The low profile component of claim 14, wherein the first magnetic core, the second magnetic core, and the preformed coil are interfitted with one another.

16. The low profile magnetic component of claim 14, wherein the component is a power inductor.

17. The low profile magnetic component of claim 14, wherein the coil comprises more than one winding.

18. A method of manufacturing a low profile inductor component comprising:

providing a first core fabricated from a magnetic permeable material, said first core defining a receptacle;

providing a second core fabricated from a magnetic permeable material, said second core being fabricated independently from the first core;

providing a coil formed independently from the first and second cores, said coil comprising first and second leads and a plurality of turns therebetween selected to provide a preselected inductance value for the inductor component, wherein the receptacle receives the coil and at least one of the first and second cores include a projection insertable into the core;

assembling the first core, the second core, and the coil so that substantially all of the turns of the coil are located in the receptacle, the projection is inserted into the coil, and a non-magnetic gap is established at an end of the projection;

bonding the cores to one another in a fixed position relationship; and terminating the first and second leads to surface mount terminations; wherein the coil includes an inner periphery and an outer periphery, wherein each of the first and second leads connect to the coil at the outer periphery.

19. The method of claim 18 wherein the coil is configured such that a distance between the first and second core is minimized.

* * * * *

UNITED STATES PATENT AND TRADEMARK OFFICE

CERTIFICATE OF CORRECTION

PATENT NO. : 8,289,121 B2
APPLICATION NO. : 12/138792
DATED : October 16, 2012
INVENTOR(S) : Yipeng Yan, Robert James Bogert and Baoqi Wang It is certified that error appears in the above-identified patent and that said Letters Patent is hereby corrected as shown below:

In the Claims

In Column 13, Line 23, in Claim 1, delete “and plurality” and insert therefor -- and a plurality --.

In Column 13, Line 64, in Claim 8, delete “and plurality” and insert therefor -- and a plurality --.

In Column 14, Line 31, in Claim 14, delete “of turns” and insert therefor -- of the turns --.

Signed and Sealed this
Fifteenth Day of October, 2013

Teresa Stanek Rea
*Deputy Director of the United States Patent and Trademark Office*